United States Patent [19]

Shaw

[11] Patent Number: 4,941,513

[45] Date of Patent: Jul. 17, 1990

[54] METHOD FOR REMOVING AN INCORRECT PIECE OF WEFT THREAD FROM A SHED

[75] Inventor: Henry Shaw, Vleteren, Belgium

[73] Assignee: Picanol N.V., Ieper, Belgium

[21] Appl. No.: 321,832

[22] Filed: Mar. 10, 1989

[30] Foreign Application Priority Data

Mar. 10, 1988 [BE] Belgium ..... 8700271

[51] Int. Cl.[5] ..... D03D 47/30; D03D 51/00

[52] U.S. Cl. ..... 139/116.2

[58] Field of Search ..... 139/116 A, 429, 450, 139/1 R, 443, 116.1

[56] References Cited

FOREIGN PATENT DOCUMENTS

| | | |
|---|---|---|
| 0207470 | 1/1987 | European Pat. Off. . |
| 2248353 | 5/1975 | France . |
| 216949 | 12/1984 | Japan . |
| 3256749 | 10/1988 | Japan . |

*Primary Examiner*—Andrew M. Falik

*Attorney, Agent, or Firm*—Bacon & Thomas

[57] ABSTRACT

A method for removing an incorrectly inserted piece of weft thread from the shed of a weaving machine includes the steps of inserting a pulling thread which is connected to the incorrectly inserted weft thread and drawing out both threads from the insertion end of the shed. A thread guiding element is used to guide the weft thread as it is withdrawn from the shed.

15 Claims, 8 Drawing Sheets

8
20
48
38
1
18
30
68
2
39
28
67
66
65
63
64
3
31
43
44
47
27
45
46

8
20
48
38
1
18
30
68
2
39
66
28
67
63
64
55
3
31
43
44
47
27
70
45
46

8
20
48
38
1
18
30
68
2
39
66
28
67
63
64
55
3
31
44
47
43
27
70
28
45
46

8
20
48
38
1
18
30
68
2
39
28
64
55
3
71
44
47
31
43
27
45
46

8
20
48
38
1
18
30
68
2
39
28
64
3
31
48
71
44
27
43
47
46
45

45
63
51
75
3
79
43
80
66
77
76
78
81
79
F18
64

80
82
75
75
76
83

8
20
48
38
1
18
30
51
68
66
62
2
39
67
28
43
3
48
31
72
44
27
47
46
45

8
20
34
13
48
38
18
1
51
68
2
39
66
62
63
67
70
64
28
73
3
30
43
31
72
44
47
46
27

8
20
34
13
48
38
18
1
51
55
68
2
39
66
62
63
67
70
64
28
73
65
3
31
72
43
44
47
46
27
45

8
20
34
13
48
38
18
1
73
30
51
55
68
2
39
66
74
64
28
63
65
3
31
43
44
47
46
27
45

8
20
34
13
48
38
18
1
30
51
68
2
66
73
64
74
63
3
39
28
71
44
47
31
43
27
46
45

44
94
20
88
95
96
38
40
39
66
55A
18
1
90
30
92
68
89
65
62
89
67
63
64
D
91
98
43
45
27
28

44
94
20
88
95
96
38
40
39
18
1
90
30
32
55A
68
89
66
63
89
67
64
65
91
98
72
43
45
27

44
95
71
88
40
39
18
64
30
32
68
91
55A
98
43
45
27

44
88
95
20
96
38
40
39
27
18
1
90
30
32
68
63
66
67
64
70
91
43
72
45
55A
65
98

44
95
88
96
38
40
39
27
18
1
90
73
30
32
68
98
66
67
63
64
70
91
65
55A
43
45

44
95
88
96
38
40
39
27
18
1
73
90
30
32
68
98
66
67
63
74
70
91
65
55A
43
45
64

METHOD FOR REMOVING AN INCORRECT PIECE OF WEFT THREAD FROM A SHED

BACKGROUND OF THE INVENTION

This invention concerns a method for removing an incorrect piece of weft thread which is not bound in by the warp threads from the shed, which may or may not have been beaten up against the fell line.

A weaving machine is known from British patent No. 1.430.520 which is equipped with means for removing from the shed pieces of weft thread, in particular pieces of weft thread which have arisen as a result of weft break in the shed. In the event of a thread break, both pieces of weft thread are simply pulled out of the shed by their ends which lie outside the shed. Such a method has the disadvantage that the pieces of weft thread, particularly when they have already been beaten up, are difficult to remove from the fell line.

A solution for the faultless release of an incorrect piece of weft thread has been described in Dutch patent application No. 8602191 of applicant, in which the piece of weft thread which has already been beaten up is first released from the fell line and then removed from the shed. In this method the incorrect piece of weft thread closest to the weft insertion side of the shed remains connected to, or fastened to, the weft thread supply. If the piece of weft thread has already been bound in by the warp threads, the binding is undone and a new weft thread is inserted in the shed. The newly inserted weft thread carries, during its transport through the shed, the incorrect piece of weft thread with it, so that the latter is released in the form of a loop and subsequently removed from the opposite side of the shed. The fact that the incorrect piece of weft thread is released in the form of a loop means that only a limited force need be exercised for this purpose. However, in the case of a gripper weaving machine, the aforementioned method has the disadvantage that because of the limited motion of the grippers, the incorrect piece of weft thread cannot be pulled entirely free.

Because of the fact that in the method according to NL No. 8602191, the newly inserted weft thread and the incorrect piece of weft thread connected to it are removed from opposite the insertion side of the shed, this method is not easily adaptable to removing loose incorrect pieces of weft thread from the shed in a weaving machine.

SUMMARY OF THE INVENTION

The object of the present invention is a method in which the aforementioned disadvantages are systematically eliminated.

To this end the invention concerns a method for removing from the shed an incorrect piece of weft thread which is not bound in by the warp threads and which extends to one end of the shed. The method includes the steps of inserting in the shed from the aforementioned end a quantity of thread which is connected to aforementioned the incorrect piece of weft thread, such that a pulling thread is formed in the form of a loop, and providing a thread guide element at the end of the shed situated opposite the end from which the aforementioned quantity of thread was inserted. The pulling thread is guided round the thread guide element, and drawn from the insertion end of the shed from in such a way that the incorrect piece of weft thread is released from the fell line in the form of a loop, is guided behind the aforementioned thread guide element, is transported back through the shed and is finally removed from the shed at the end of the shed from which the aforementioned quantity of thread was inserted.

In the event that one end of the aforementioned incorrect piece of weft thread extends to the weft insertion side of the shed, this piece of weft thread is left by preference connected to its thread supply, after which the aforementioned quantity of thread for insertion needed for the pulling thread is then created by weft thread from the same thread supply.

In a special embodiment of the invention, in the event of a thread break resulting in the creation of two pieces of weft thread in the shed, both pieces of weft thread are removed in the form of a loop from the shed.

BRIEF DESCRIPTION OF THE DRAWINGS

With a view to illustrating the characteristics according to the invention more clearly, a number of preferred embodiments are described below but without being in any way exhaustive and with reference to the attached drawings where:

FIG. 8 shows an enlarged view of the section indicated in FIG. 7 by F8;

DETAILED DESCRIPTION OF THE PREFERRED EMBODIMENT

Figure 1:
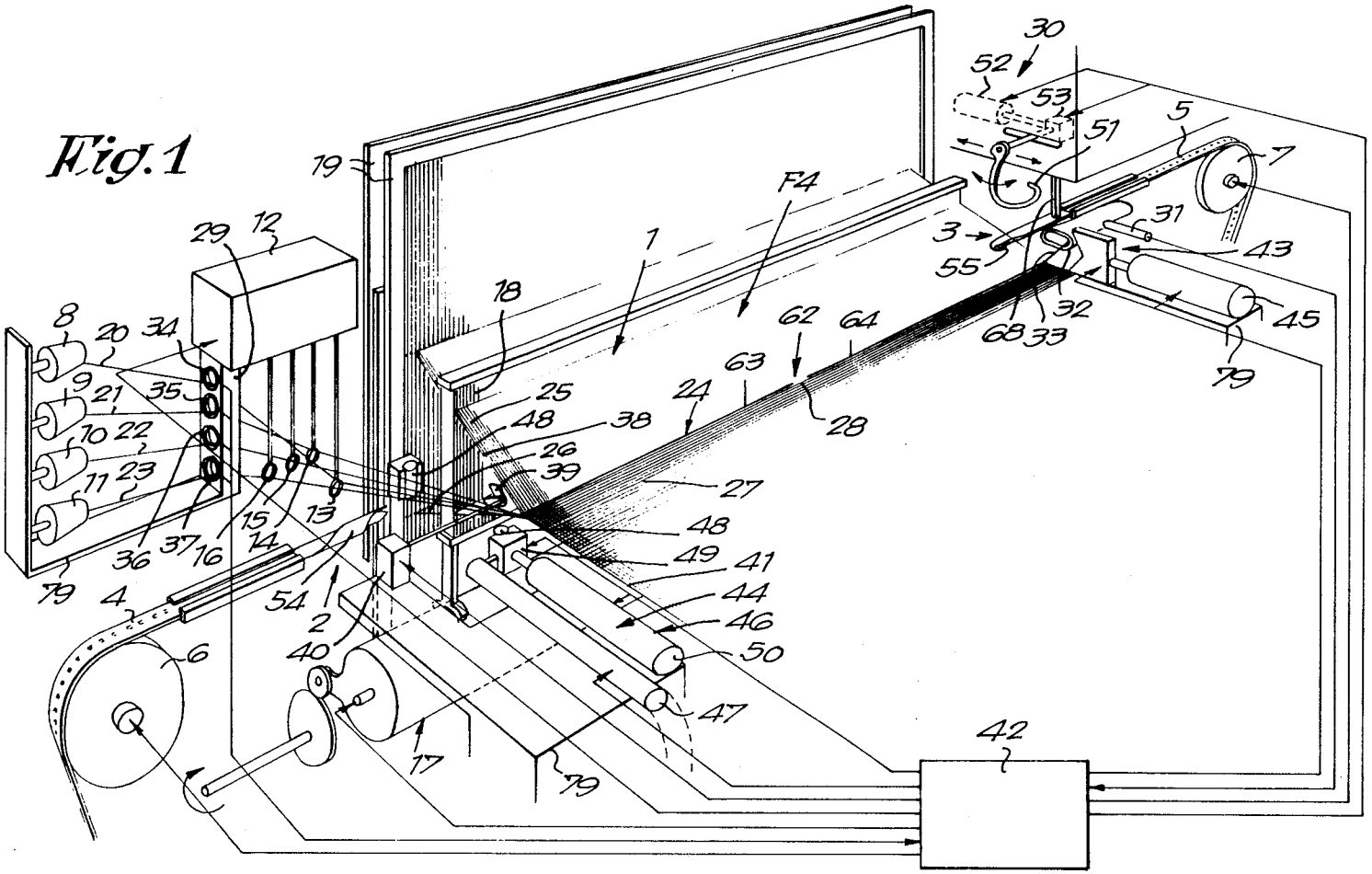
FIG. 1 is a perspective view of part of a gripper weaving machine, in particular the equipment situated next to the shed, in which a break in the weft thread has occurred in the shed.

In FIG. 1 the shed 1 of a gripper weaving machine and the apparatus situated around it is shown. Here are shown in the known way the feeder gripper 2, the carrier gripper 3, their respective lances 4 and 5, the lance drives 6 and 7, a number of thread supplies 8 to 11 inclusive, the thread presentation mechanism 12 with the respective thread guiding elements 13 to 16 inclusive, the batten 17 with the reed 18, and the heald frames 19.

Also in are shown FIG. 1 the respective weft threads 20 to 23 inclusive, the most recently inserted weft thread 24, the upper warp 25, the lower warp 26, the fabric 27, the fell line 28, a first weft detector 29 for the detection of the arrival of a weft thread 24 at the end 30 of shed 1, a second weft detector or thread detector 31 for the detection of broken weft threads or excessively long weft threads, and means 32, for example a suction nozzle, for keeping the end 33 of weft thread 24 stretched. The first weft detector consists of detectors 34 to 37 inclusive which supply signals in relation to the movement of the weft threads 20 to 23 inclusive. When a weft thread breaks during insertion into the shed, the relevant weft detector detects that there is no more motion.

At the end 38 of the shed next to the feeder gripper 2 a cutter 39 is located in the known way, with preferably an electrical drive 40. In a gripper weaving machine on which the weft threads 20 to 23 inclusive are left hanging in the rest state at the fabric edge 41, the weft cutter 39 is mounted in such a way that a weft thread presented to the feeder gripper is pulled into the open cutter and cut free at the beginning of the weft insertion.

As further indicated in FIG. 1 a number of accessories are provided which can be operated in a suitable way by means of a control unit 42, such as the fastening apparatus 43 for fastening threads, and means 44 for drawing the weft threads from the shed.

The fastening apparatus 43 consists for example of a conventional knotting apparatus and is consequently only schematically illustrated in the figure. Of course it contains the necessary driving means for the operation of the apparatus, as well as for presenting it to the threads to be fastened. Here the motion can for example occur by means of a pneumatic cylinder 45.

The illustrated means 44 consist primarily of a combination of a mechanical thread removal apparatus 46 and a suction nozzle 47. The apparatus 46 consists primarily of two rollers 48 provided with at least one driving motor 49, which in the rest condition are located apart from one another next to the front end 38 of the shed and which can be placed against one another by a driving means 50 such as a pneumatic cylinder, this being arranged such that by their rotation a thread held between them can be removed from the shed 1. It is obvious that other thread removal devices can be used as well. Aforementioned suction nozzle 47 can be moved together with the movable roller and is situated with its front end next to the relevant roller.

In a particular application a movable thread guiding element 51 is mounted at end 30 of shed 1 consisting of a hook which can by means of drive means 52 and 53 execute a translational and a rotational movement respectively.

Figure 2:
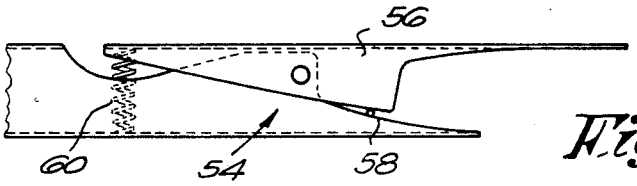
FIGS. 2 and 3 show the clips of the feeder gripper and the carrier gripper of a gripper weaving machine.
Figure 3:
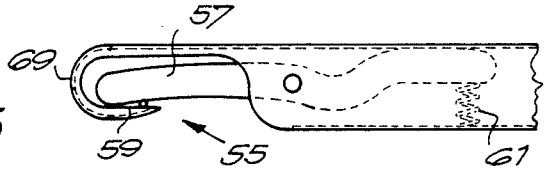

It will be understand that the feeder gripper 2 and the carrier gripper 3 are provided at their ends with thread clips 54 and 55 which, as illustrated in FIGS. 2 and 3, consist primarily of lever sections 56 and 57. Lever sections 56 and 57 work at one end in conjunction with fixed clamping surfaces 58 and 59, with the assistance of elastic means 60 and 61. Such mechanisms are for example known from U.S. Pat. Nos. 4,860,800 and 4,875,505.

Figure 4:
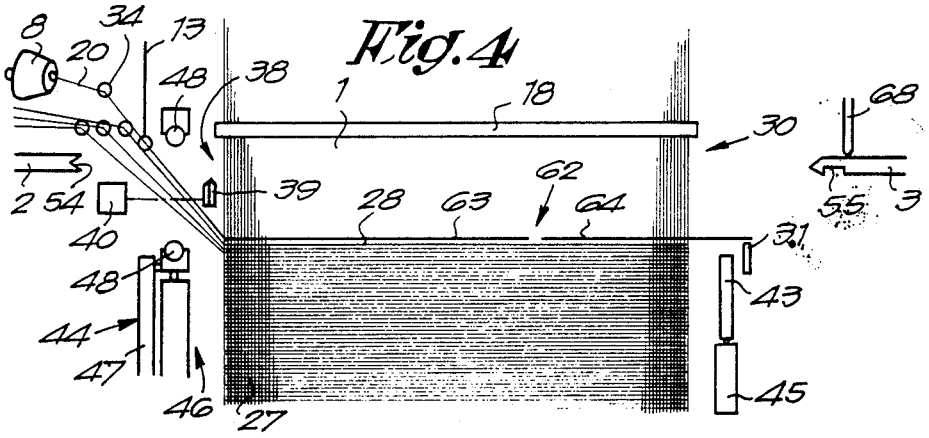
FIG. 4 shows a schematic view along arrow F4 in FIG. 1.

In FIGS. 1 and 4 a thread break 62 has occurred as a result of which on the one hand an incorrect piece of weft thread 63 has been created which extends to the insertion end 38 of the shed 1 and is connected to the weft thread supply 8 from which the broken weft thread 24 is delivered, and on the other hand, a loose, incorrect, broken-off piece of weft thread 64 which is, because of the thread break 62, carried further than normal by means of the suction nozzle 32 and consequently extends to the second thread detector 31.

A purpose of the invention is to ensure that the piece of weft thread 63 is fully and easily removed in the form of a loop from the shed regardless of its length.

As a result of the signal from the second thread detector 31 the thread presentation mechanism 12 is controlled in such a way by means of the control unit 42 that in the first place none whatsoever of the weft threads 20 to 23 inclusive are brought in the course of the feeder gripper 2. The normal weaving process is interrupted by this and the beaten-up incorrect weft thread 24 is released by undoing the binding of the warp threads, at least if this binding already exists, by means of the known method of pick finding.

Figure 5:
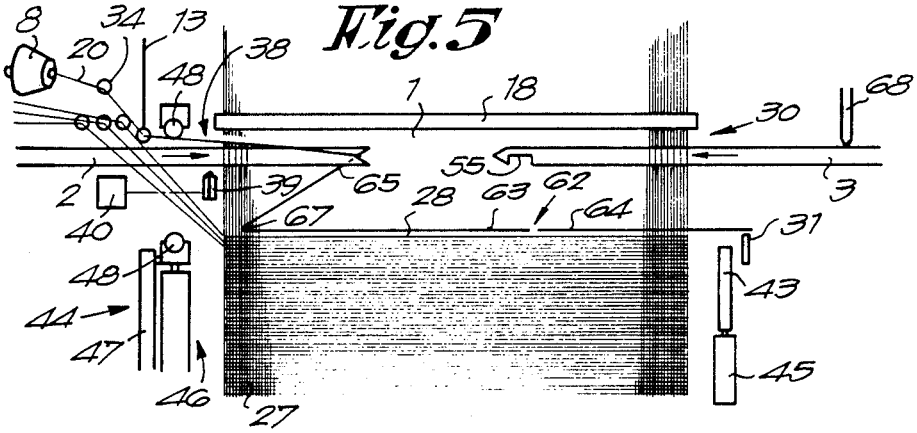

Subsequently a quantity of the relevant weft thread 20 is inserted in the form of a loop 65 in the shed 1 by, as illustrated in FIG. 5, causing the feeder and carrier grippers 2 and 3 to execute one cycle of motion, such that one thread, hereinafter referred to as pulling thread 66, is formed. Upon the insertion of the new quantity of weft thread 20 the piece of weft thread 63 is left connected to the thread supply 8. This is achieved by not operating the weft cutter 39 and ensuring that the weft thread 63 passes freely over the cutter. During this cycle the piece of weft thread 63 is pulled free in the form of a loop 67. FIG. 6 again shows a situation where the pulling thread 66 is gripped by the carrier gripper 3. Here the relevant weft thread 20 is gripped as shown in more detail in FIG. 3.

Figure 8:
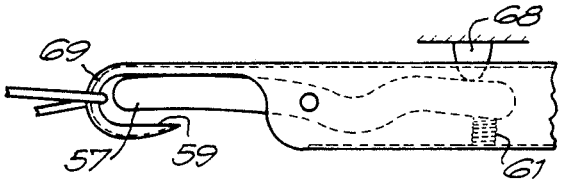
FIGS. 5 to 11 inclusive show step by step the method according to the invention, where
Figure 7:
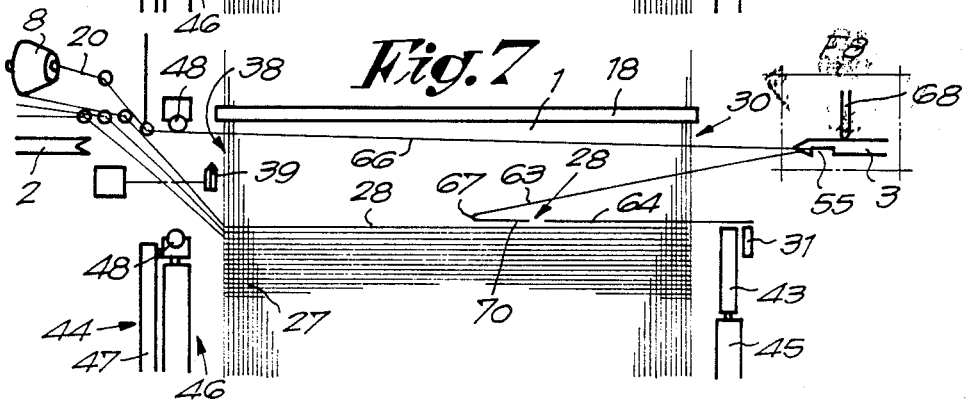

As shown in FIG. 7, in its most extreme position the carrier gripper 3 comes into contact with a striker 68 which presses the clip 55 open, so that the relevant weft thread 20 is caused to be located freely behind a thread guide element, which in this case is formed by the hook-shaped part 69 of the carrier gripper. The pressing open of the clip 55 is illustrated in FIG. 8. It is clear that the lever part 57 exerts no pressure on the thread, so that the piece of weft thread 63 can be pulled freely along the hook-shaped part 69.

Figure 9:
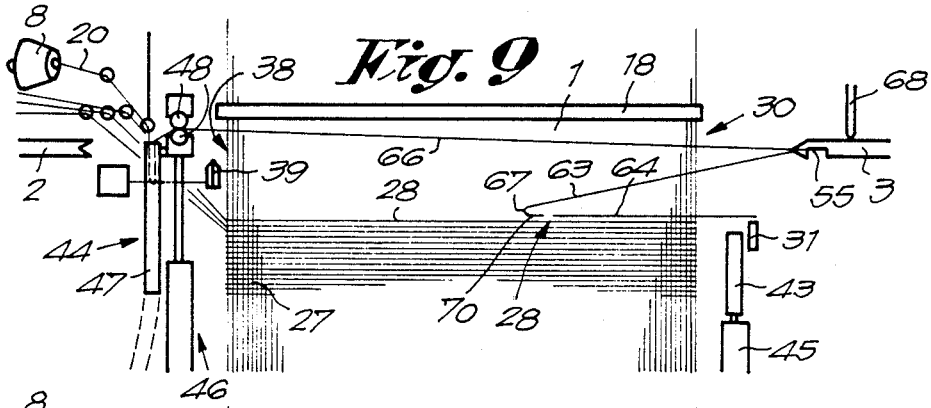

Subsequently, as shown in FIG. 9, the rollers 48 of the thread removal apparatus 46 next to the foremost end 38 of shed 1 are presented to the pulling thread 66. By causing these rollers 48 to rotate, the pulling thread 66 is pulled from the shed 1 and the piece of weft thread 63 is further released and removed from the shed 1, the piece of weft thread being forced to move along the hook-shaped part 69 in such a way that the piece of thread 70 which is still beaten up, if any, is further released in the form of a loop 67.

Figure 10:
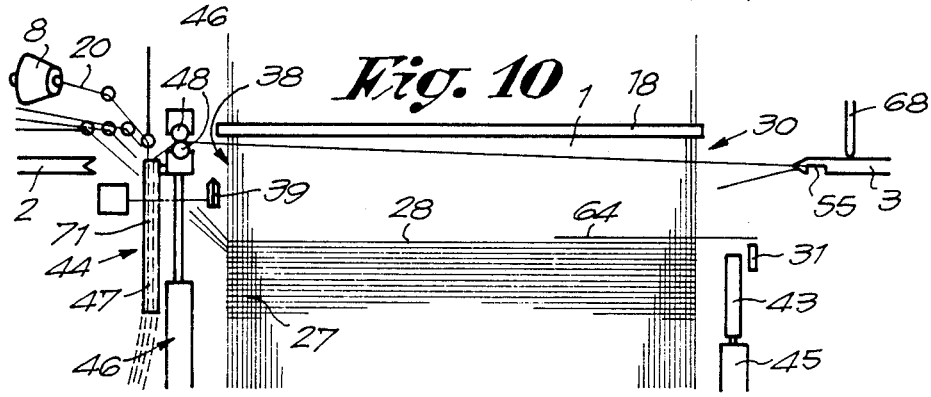
Figure 11:
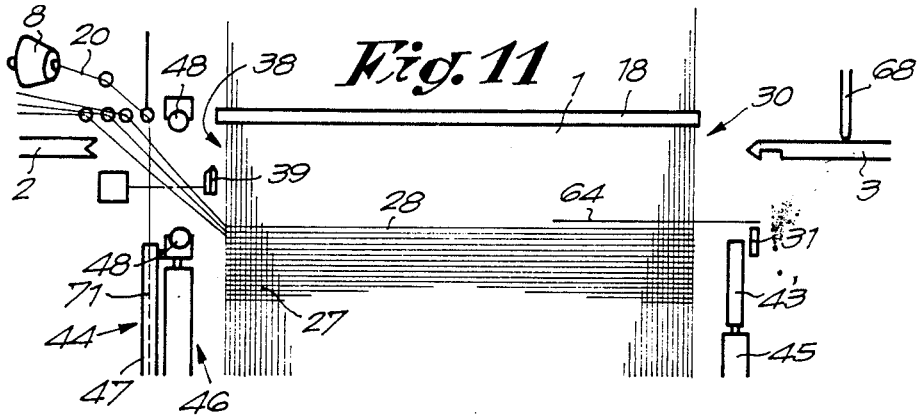

As shown in FIG. 10 the pulling thread 66 and the piece of weft thread 63 connected to it is sucked up entirely in the suction nozzle 47. Afterwards the aforementioned means 44 are returned to the rest condition as shown in FIG. 11. Here the weft thread 20 is held stretched by means of the suction nozzle 47. The thread waste 71 is only cut off by means of the cutter 39 when the following length of weft thread 20 is inserted.

According to a special variant of the invention both incorrect pieces of weft thread 63 and 64 are pulled simultaneously out of the shed 1, details of this being shown in FIGS. 12 to 16 inclusive.

Figure 6:
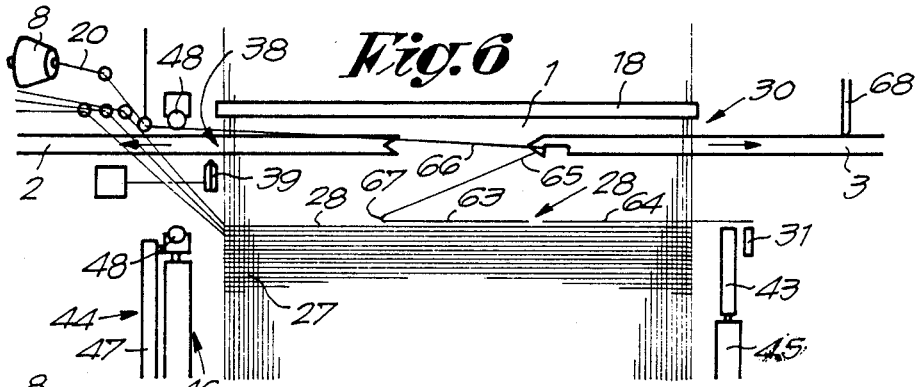
Figure 12:
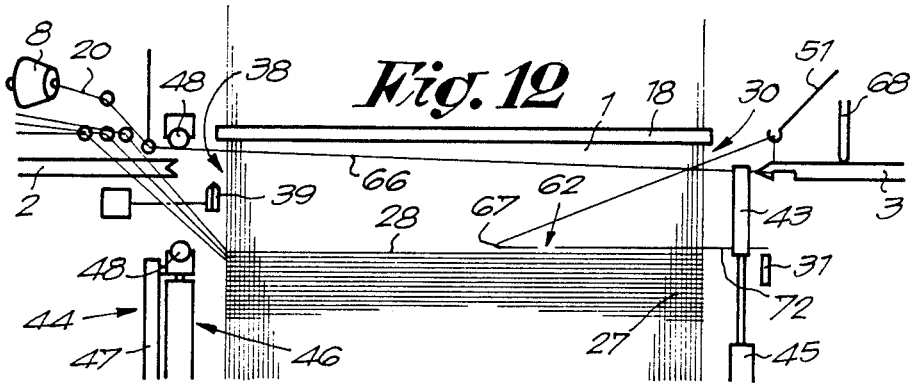
FIGS. 12 to 16 inclusive show a special embodiment of the invention.

First of all a pulling thread 66 is inserted in the shed 1 in a similar way to that shown in FIGS. 5 and 6, except that, as shown in FIG. 12, the grippers 2 and 3 are in the first instance not fully returned to their extreme positions. As a result of this important difference, as shown in FIG. 3, the weft thread 20 remains clamped in the carrier gripper 3.

As further shown in FIG. 12, that part of the incorrect piece of weft thread 63 which has already been pulled free by means of the separate thread guide element 51 can be taken and pulled to one side, so that the fastening apparatus 43 can be presented to the pulling thread 66 and the end 72 of the piece of weft thread 64 lying beyond the shed 1.

Aforementioned thread guide element 51 may consist of any randomly chosen hook-shaped element which is capable of taking exactly one thread, namely the piece of weft thread 63 close to the carrier gripper 3. A similar hook-shaped element and its drive is for example described in Dutch patent application No. 8602826 of applicant.

Figure 13:
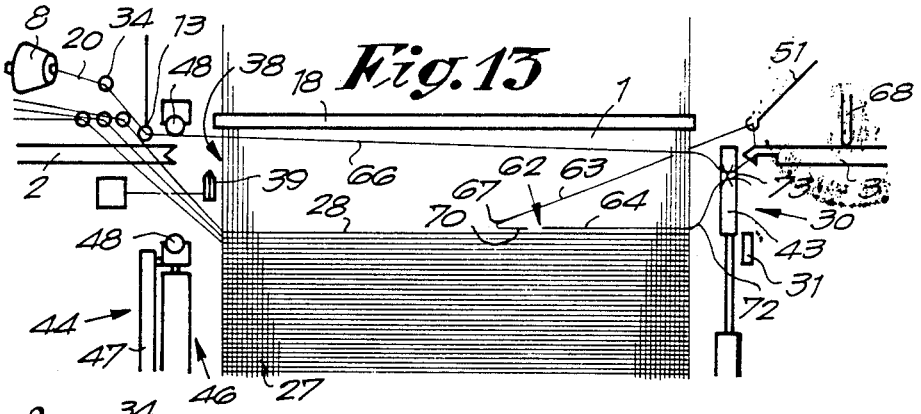
Figure 14:
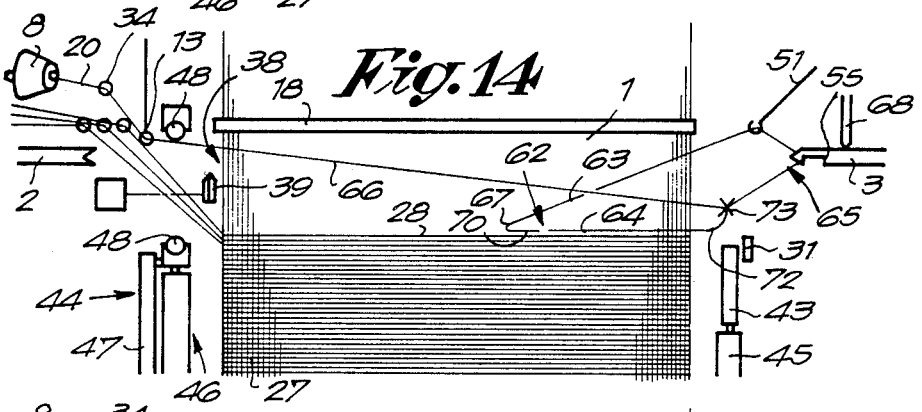

Subsequently a fastening 73 is made as shown diagrammatically in FIG. 13. Afterwards the grippers 2 and 3 are moved further from one another, whereby as schematically indicated in FIG. 14 the clip 55 of the carrier gripper 3 comes into contact with aforementioned striker 68, so that the thread is positioned free to move behind the hook-shaped part 69.

Figure 15:
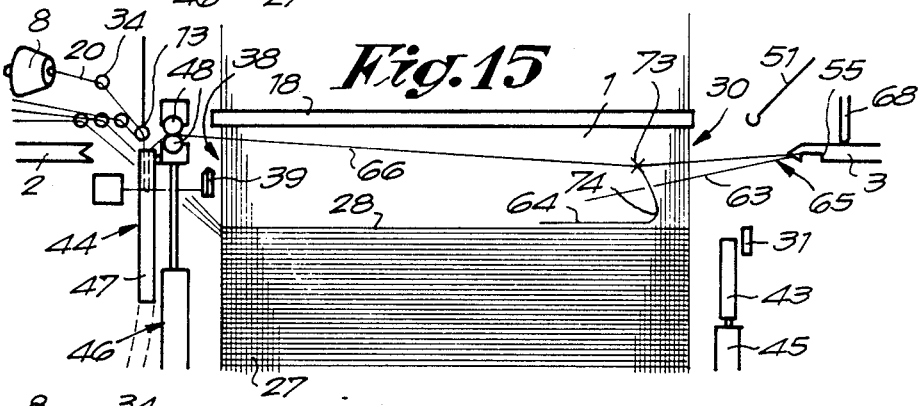

In a similar way to the previous embodiments, the means 44 next to the end 38 of the shed 1 are presented to the weft thread 20, so that by actuating these the pulling thread 66 is pulled from the shed 1. What is important is that as shown in FIG. 15 the piece of weft thread 64 is also pulled free from the fell line 28 in the form of a loop 74 and in this way can be easily removed from the shed. It will be clear that the pulling thread 66 in the meantime may or may not be released from the thread guide element 51.

Figure 16:
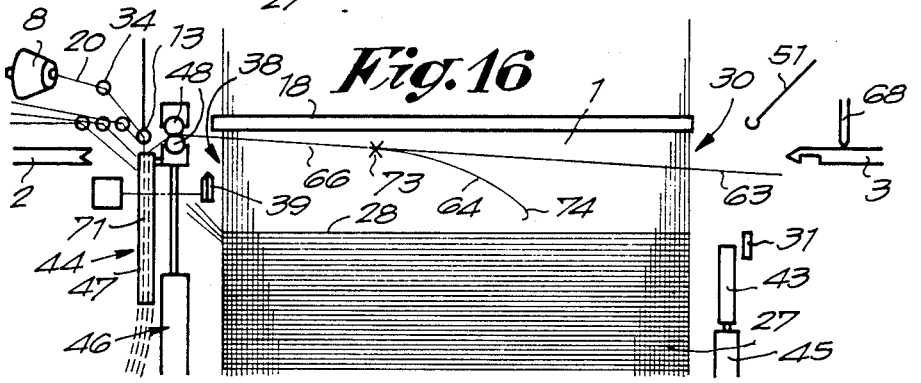

From FIG. 16 it will be clear that both the pulling thread 66 and both pieces of the weft thread 63 and 64 connected to them are sucked into the suction nozzle 47, after which a rest condition similar to that shown in FIG. 11 will be reached.

The thread guide elements 13 to 16 inclusive have eyes in this embodiment as is known, and as can be seen in FIG. 1, the weft threads 20 to 23 inclusive remain connected to the edge 41 of the fabric when they are not being inserted in the shed. They are cut free only at the beginning of their insertion by means of a cutter 39. Nevertheless thread presentation systems are known such as for example described in U.S. Pat. No. 4,840,203, wherein the weft threads are cut from the inserted weft thread after every insertion and wherein the free ends created in consequence are held in movable thread clips and are in this way presented to the feeder gripper 2 in relation to the insertion pattern. It will be apparent that the thread waste 71 is in this case cut off by a cutter specially provided to this end. The thread end created in this way is restored to the relevant thread clip.

The fastening 73 may be realized in any suitable way whatsoever. The fastening may for example by made by means of knotting, by a splice, by using a special fastening agent, etc. The aforementioned special fastening agent may for example consist of a staple, a thread wound round the piece of weft thread 64 and the pulling thread 66, or a drop of wax or fast-setting adhesive applied to the threads being fastened to one another.

Figure 17:
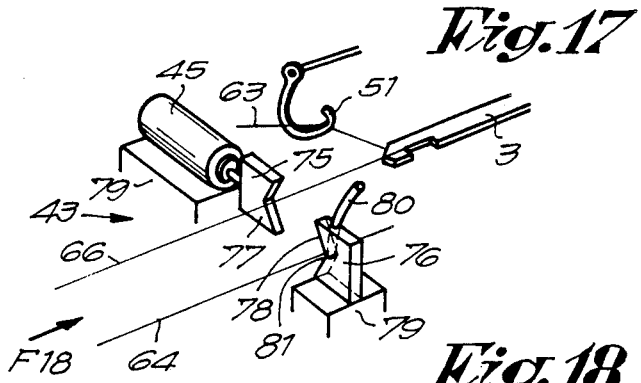
FIG. 17 shows a particular special possibility for fastening aforementioned pulling thread to the loose piece of weft thread to be removed.
Figure 18:
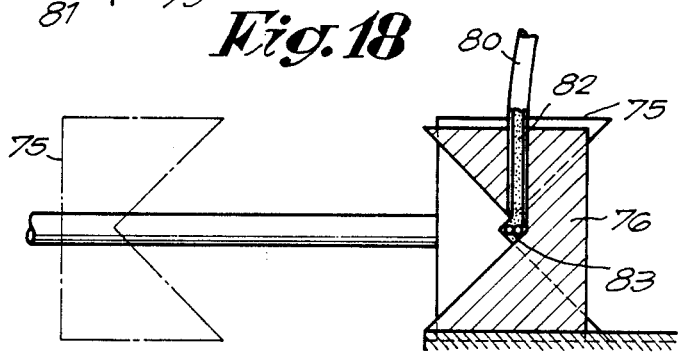
FIG. 18 shows a view along arrow F18 in FIG. 17 during the fastening to one another of two threads.

By way of clarification FIGS. 17 and 18 show how the pulling thread 66 and the piece of weft thread 64 can be fastened to one another by means of a fast-setting adhesive or similar. To this end use is made of an fastening apparatus 43 consisting of two elements 75 and 76 which are installed on both sides next to the end 30 of the shed 1 and which have V shaped profiles 77 and 78 which face one another. The driving means can consist for example of the aforementioned pneumatic cylinder 45 permitting the first element 75 to be brought next to the second element 76. The second element 76, is like all the parts already mentioned, mounted in a suitable way on the frame 79 of the weaving machine and contains a channel 80 which comes out exactly in the deepest edge 81 of the V shaped profile 78 and through which, as shown in FIG. 18, fast-setting adhesive 82 can be supplied.

According to FIG. 18 the fastening 73 is achieved by first applying a small quantity 83 via channel 80 of the aforementioned adhesive 82 in the edge 81 and subsequently moving the pneumatic cylinder 45 so that the first element 75 is moved next to the second element 76. By its movement the first element 75 carries the pulling thread 66 and the piece of weft thread 64 with it and pushes these together in the V shaped profile 78 in which the quantity of adhesive 83 has been applied. After this quantity of adhesive 83 has set, elements 75 and 76 can be withdrawn from one another, so that the fastened threads remain behind. In this way the threads can be fastened to one another in a quick way without having to have a precise knowledge of their whereabouts in advance.

It will be recognized by those skilled in the art that instead of grippers 2 and 3, use could also be made of a separate thread carrying element, for example of the type described in Belgian patent application No. 8700223 of applicant. The invention is consequently not just limited to gripper weaving machines but can be adopted for any type of weaving machine whatsoever. In the following the use of a thread carrying device in an airjet weaving machine is described with reference to FIGS. 19 to 25 inclusive.

Figure 19:
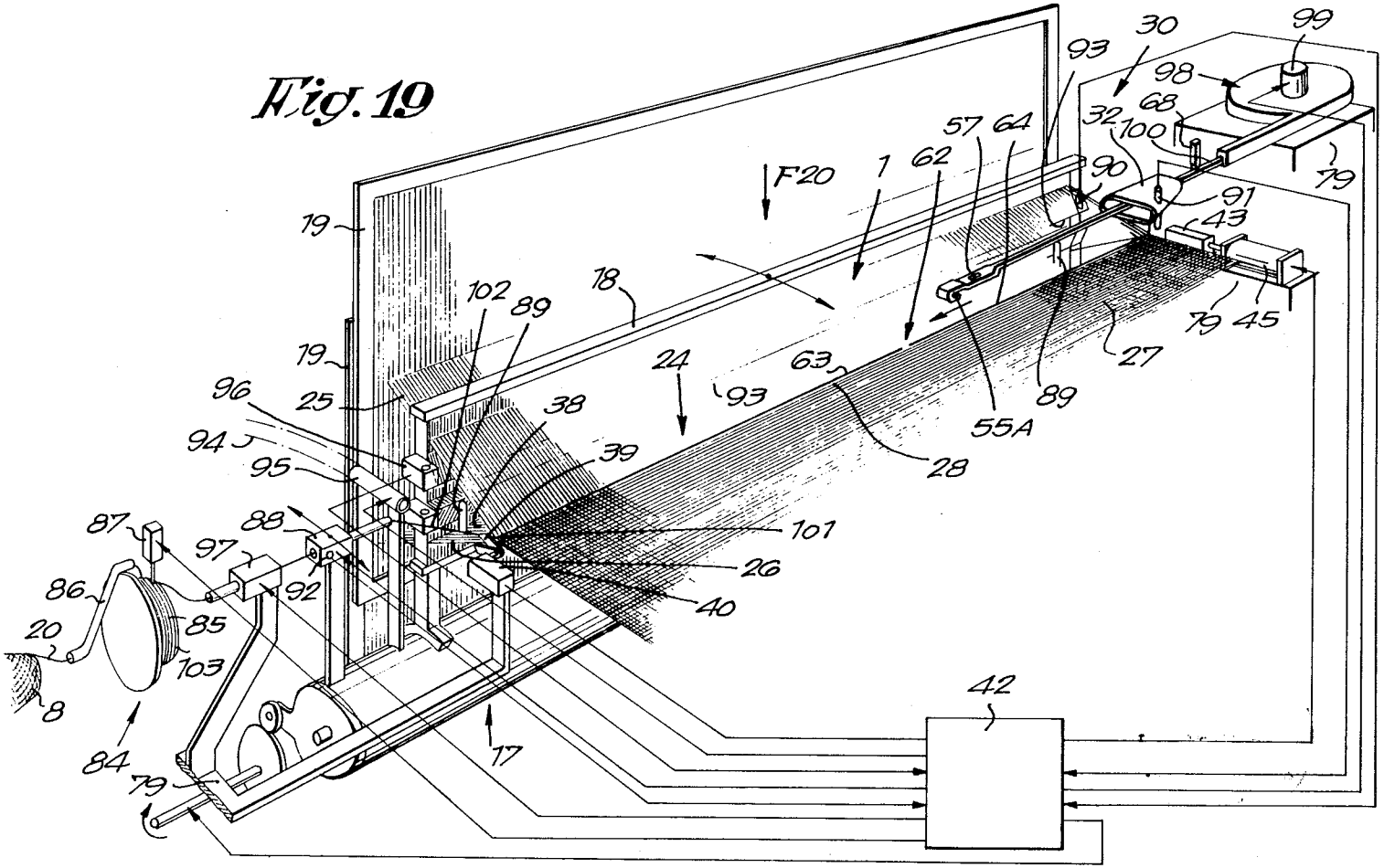
FIG. 19 is a perspective view and FIGS. 20 to 25 inclusive are schematic views of an embodiment of the invention in which use is made of a special thread carrying device.
Figure 20:
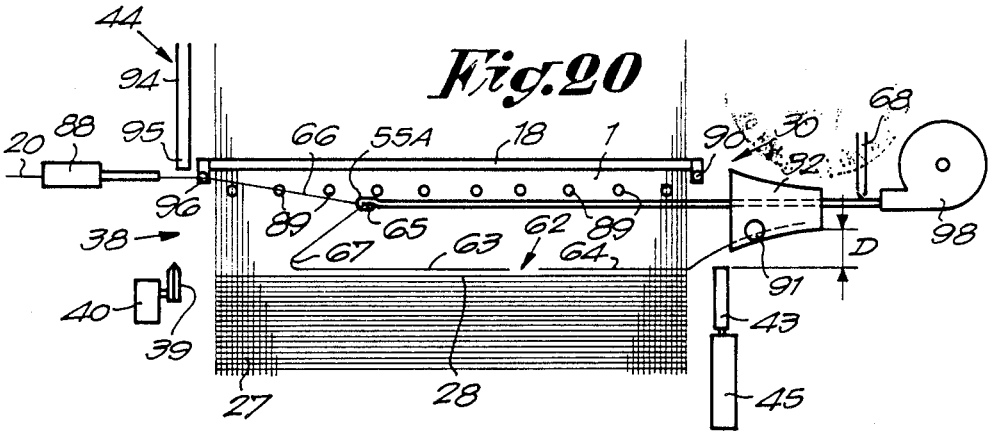

In FIG. 19 the parts which have already been shown in FIG. 1 are referred to by the same reference numbers. Apart from these a number of independently known parts are shown, such as a prewinder 84 consisting of a fixed winding drum 85, a rotating winding arm 86 and thread blocking apparatus 87 which can stop or release turns respectively; a main nozzle 88, auxiliary nozzles 89; a first weft sensor 90 for the detection of the arrival a weft thread 24 at the end 30 of the shed 1; a second weft sensor or thread detector 91 located in aforementioned suction nozzle 32 for detecting broken weft threads or excessively long weft threads after these have been beaten up by the reed 18 against the fell line 28 and possibly a thread detector 92 which checks for the presence of thread in the thread canal of the main nozzle 88. The reed 18 is in this case U shaped and is provided with a thread transport channel 93.

The aforementioned weft cutter 39 stands in this case directly in the extension of the fell line 28 and is by preference driven by an electrical drive 40, driven as described in Belgian patent application No. 87 00224 of applicant.

Aforementioned means 44 for removing the thread from the shed consist in this case exclusively of a suction nozzle 95 connected to a suction line 94 and which moves with the batten 17. A thread detector 96 is installed between the end 38 of the shed 1 and the inlet of the suction nozzle 95.

Also shown in FIG. 19 are a counter nozzle 97 and the thread carrying device 98.

The thread carrying device 98 allows a motor 99 to unroll a spirally roller thread carrying element 100, consisting for example of a relatively stiff tape of synthetic material, and pushes it from end 30 through the suction nozzle 32 into the shed 1.

The thread carrying element 100 is provided on its front end with a thread clip 55A, which is illustrated only schematically in FIG. 19, but which is basically the same in construction as the clip which is shown in FIG. 3. This thread clip 55A works in the retracted state of the thread carrying element 100 in conjunction with the striker 68 mentioned above.

In FIG. 19 a thread break 62 has occurred in the middle of the shed 1. The broken-off piece of weft thread 64 is detected by means of a second weft detector 91, which is mounted a distance D before the fell line 28 just before beating up, or at the very latest at the moment of beating up itself. As a result of the signal from the second weft detector 17 the drive 40 of the weft cutter 39 is temporarily halted in order to avoid the cutting free of the piece of weft thread 63. The drive of the weaving machine is also stopped, preferably with the batten 17 in its rearmost position. When the batten 17 is moved backwards the main nozzle 88 will also move backwards, so that the distance between the latter and the start 101 of the fell line 28 is enlarged. During this action in order to prevent the piece of weft thread 102 breaking between the prewinder 84 and the shed 1 a number of turns 103 are released. The counter nozzle 97 is activated in order to prevent the released turns 103 from being prematurely inserted into the shed.

The method by which only the piece of weft thread 63 is removed from the shed is illustrated step by step in FIGS. 19 to 22 inclusive. In FIG. 19 the thread carrying element 100 is pushed into the shed 1 until the thread clip 55A takes the piece of weft thread 102 held taut by means of the counter nozzle 97.

The weft thread 20 is pulled through the shed 1 in the form of a loop 65 by rolling up the thread carrying element 100. The piece of weft thread 63 is pulled free in the form of a loop 67.

In a manner similar to that described above in connection with the gripper weaving machine, the thread clip 55A comes into contact with the striker 68, causing it to open. In this case too the hook-shaped part 69 continues to form a thread guide element for the piece of weft thread 63.

Figure 21:
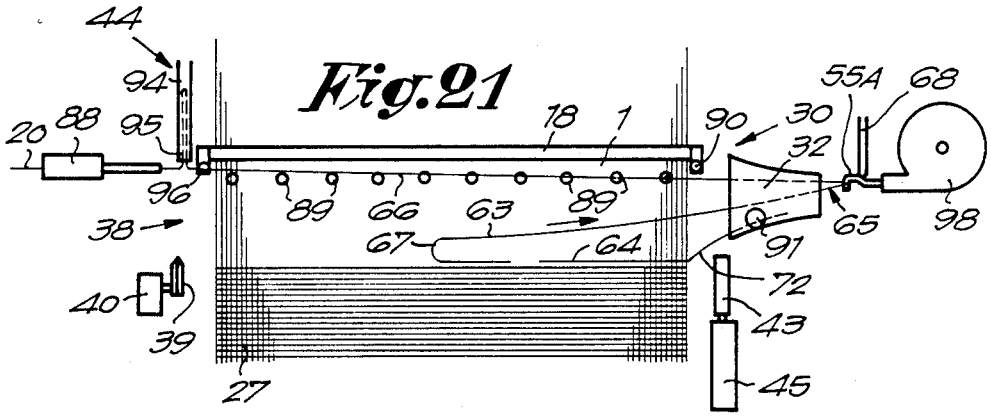

In FIG. 21 the suction nozzle 95 is made to operate and the carrying thread 66 and the piece of weft thread 63 attached to it are removed from the shed 1, so that the latter is pulled free over its entire length in the form of a loop 67 and thereby compelled to move behind aforementioned hook-shaped part 69.

Figure 22:
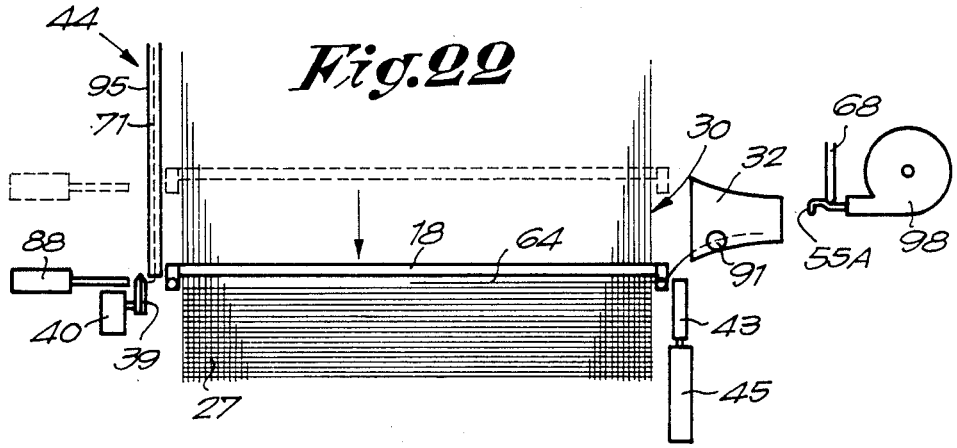

When the detector 96 no longer detects any thread, the reed 18 is moved forward so that as is clearly shown in FIG. 22, the weft thread 20 is pushed into the weft cutter 39, so that the thread waste 71 can be cut off.

Figure 23:
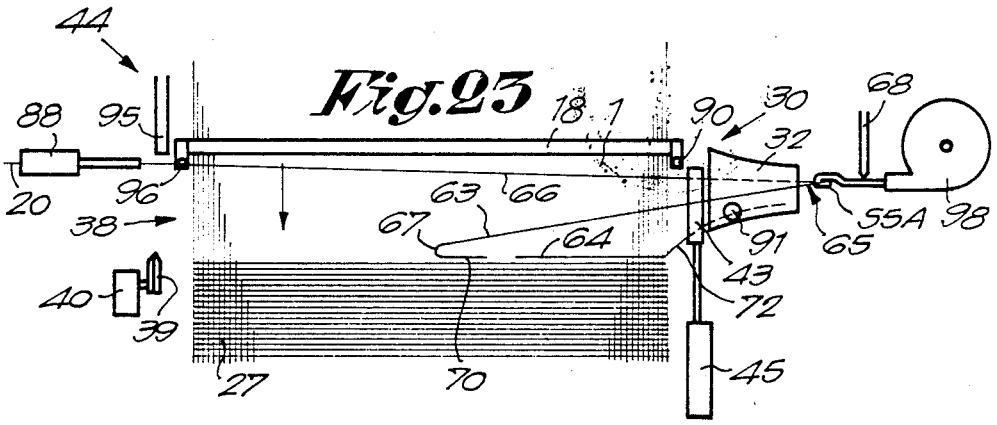
Figure 24:
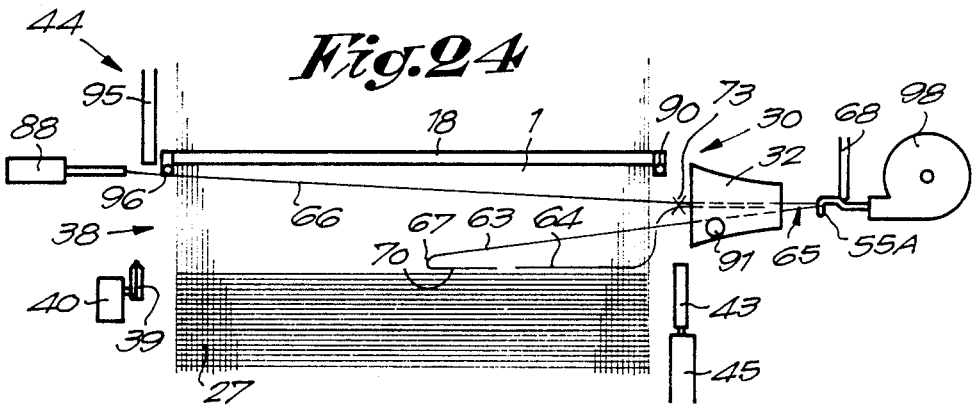
Figure 25:
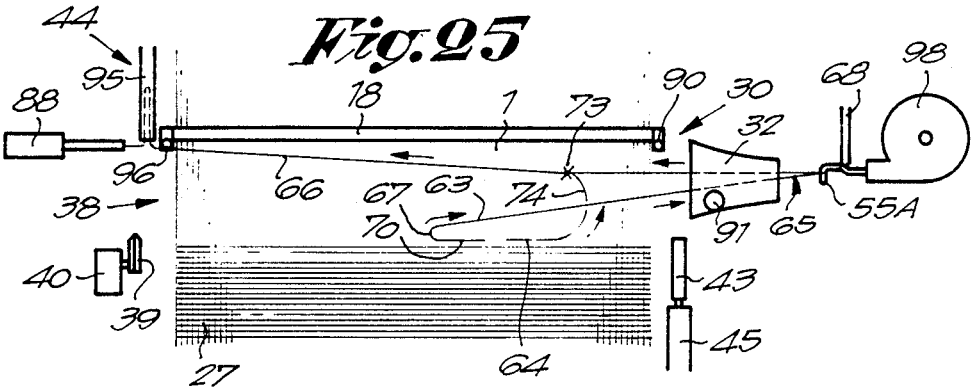

FIGS. 23 to 25 inclusive show a variant where the piece of thread 64 is connected to the carrying thread 66 in such a way that both pieces of weft thread 63 and 64 are removed simultaneously. The action is analogous to that of a gripper weaving machine.

The cutting off of the thread waste 71 takes place in the same way as in FIG. 22.

Although the quantity of thread in the foregoing detailed description required for forming the carrying thread 66 is always inserted into the shed 1 from the weft insertion side, it will be appreciated that in a further modification this can also be done from the other end 30 of the shed 1. In this modification instead of a weft thread from one of the thread supplies 8 to 11 inclusive, use is made of a thread from a specially provided thread supply mounted next to the end 30. In this special case, the invention is intended in the first instance for releasing the piece of weft thread 64 instead of 63.

The present invention is by no means limited to the embodiments described here by way of example and reproduced in the figures, but rather such a method can be achieved in various different ways without going beyond the scope of the invention.

I claim:

1. A method for removing from a fell line in a shed of a weaving machine an incorrect weft thread which is not bound in by warp threads and which extends across a length of the shed to a first end of the shed, comprising the steps of:

a. inserting a pulling thread into the shed from said first end of the shed and transporting the pulling thread through the shed, starting from a position near said first end of the shed, by means of a carrying element having a thread clip which clamps the thread during transport until the pulling thread extends over the entire length of the shed, after which the pulling thread is unclamped, said pulling thread being connected to the incorrect weft thread such that the pulling thread and incorrect weft thread form a loop when the pulling thread is extended over the entire length of the shed; and b. guiding the pulling thread around a thread guide element situated adjacent a second end of the shed opposite said first end by drawing, from said first end of the shed, the pulling thread together with the loose weft thread in such a way that the loose weft thread is released from the fell line in the form of a loop, guided around said thread guide element, transported back through the shed towards said first end, and removed form the shed at said first end.

2. A method as claimed in claim 1, wherein the incorrect weft thread extends to said first end of the shed and is left connected to its thread supply such that the pulling thread is formed by a weft thread extending from the weft supply to the first end of the shed.

3. A method as claimed in claim 2, wherein said weaving machine is a gripper weaving machine and said step of inserting the pulling thread is carried out by means of grippers.

4. A method as claimed in claim 1, wherein said thread clip is provided at a free end of said carrying element, said carrying element being in the form of a spirally roller member, and said step of inserting a pulling thread into the shed from said first end of the shed and transporting the pulling thread through the shed further comprises the step of transporting the carrying element through the shed by rolling and unrolling it.

5. A method as claimed in claim 1, wherein removal from the shed of said pulling thread together with said incorrect piece of weft thread is carried out by means of a suction nozzle.

6. A method for removing from a fell line in a shed of a weaving machine an incorrect weft thread which is not bound in by warp threads and which extends across a length of the shed to a first end of the shed, comprising the steps of:

a. inserting a pulling thread into the shed from said first end of the shed and transporting the pulling thread through the shed, starting from a position near said first end of the shed, by means of a carrying element having a thread guide and a thread clip which clamps the the thread during transport until the pulling thread extends over the entire length of the shed, after which the pulling thread is unclamped, said pulling thread being connected to the incorrect weft thread such that the pulling thread and incorrect weft thread form a loop when the pulling thread is extended over the entire length of the shed;

b. guiding the pulling thread around said thread guide when it is situated adjacent a second end of the shed opposite said first end by drawing, from said first end of the shed, the pulling thread together with the loose weft thread in such a way that the loose weft thread is released from the fell line in the form of a loop, guided around said thread guide, transported back through the shed towards said first end, and removed from the shed at said first end.

7. A method for removing from a fell line in a shed of a weaving meachine an incorrect weft thread which is not bound in by warp threads and which extends across a length of the shed to a first end of the shed, comprising the steps of:

a. inserting a pulling thread into the shed from said first end of the shed and transporting the pulling thread through the shed until the pulling thread extends over the entire length of the shed, said pulling thread being connected to the incorrect weft thread such that the pulling thread and incorrect weft thread form a loop when the pulling thread is extended over the entire length of the shed;

b. guiding the pulling thread around a thread guide element formed by a hook-shaped part of a carrier gripper and situated adjacent a second end of the shed opposite said first end by holding the hook-shaped part open in a most withdrawn position by means of a striker and drawing, from said first end of the shed, the pulling thread together with the loose weft thread in such a way that the loose weft thread is released from the fell line in the form of a loop, guided around said thread guide elements, transported back through the shed towards said first end, and removed from the shed at said first end.

8. A method for removing from a fell line in a shed of a weaving machine an incorrect weft thread which is not bound in by warp threads and which extends across a length of the shed to a first end of the shed, comprising the steps of:

a. inserting a pulling thread into the shed from said first end of the shed and transporting the pulling thread through the shed until the pulling thread extends over the entire length of the shed, said pulling thread being connected to the incorrect weft thread such that the pulling thread and incorrect weft thread form a loop when the pulling thread is extended over the entire length of the shed;

b. guiding the pulling thread around a thread guide element situated adjacent a second end of the shed opposite said first end;

c. drawing, from said first end of the shed, the pulling thread together with the loose weft thread in such a way that the loose weft thread is released from the fell line in the form of a loop, guided around said thread guide element, transported back through the shed towards said first end, and removed from the shed at said first end; and d. when a thread break has occurred in the shed so as to cause the formation of two incorrect pieces of weft thread, one of which is connected to the pulling thread and one of which is loose and extends outside the shed, fastening the loose incorrect piece of weft thread outside the shed to the pulling before the pulling thread is drawn out of the shed so that both incorrect pieces of weft thread are each released in the form of a loop from the fell line and removed from the shed.

9. A method as claimed in claim 8, wherein the removal from the shed of said pulling thread together with both of the incorrect pieces of weft thread is carried out by means of a mechanical thread removal apparatus which removes the threads between driven rollers.

10. A method as claimed in claim 9, wherein the thread waste created by the removal of the pulling thread together with the incorrect pieces of weft thread is sucked into a suction nozzle which is mounted with its front end directly next to one of said rollers.

11. A method as claimed in claim 10, wherein the weaving machine is a gripper weaving machine and the pulling thread is formed by a weft thread extending from a weft supply to the first bin of the shed, and said incorrect weft thread is held in the suction nozzle until it is inserted into the shed.

12. A method as claimed in claim 8, wherein said step of fastening includes the step of knotting the pulling thread and the loose incorrect piece of weft thread together.

13. A method as claimed in claim 8, wherein said step of fastening includes the step of splicing said pulling thread together with said loose incorrect inserted piece of weft thread.

14. A method as claimed in claim 8, wherein said step of fastening includes the step of using a fastening agent to fasten the pulling thread to the loose improperly inserted piece of weft thread.

15. A method as claimed in claim 14, wherein said fastening agent includes a fast-setting adhesive.

* * * * *